US012291820B2

(12) United States Patent
Kolari et al.

(10) Patent No.: US 12,291,820 B2
(45) Date of Patent: May 6, 2025

(54) PROCESS FOR MANUFACTURING A FIBRE WEB

(71) Applicant: Kemira Oyj, Helsinki (FI)

(72) Inventors: Marko Kolari, Espoo (FI); Jaakko Ekman, Espoo (FI); Anu Jaakkola, Espoo (FI)

(73) Assignee: Kemira Oyj, Helsinki (FI)

( * ) Notice: Subject to any disclaimer, the term of this patent is extended or adjusted under 35 U.S.C. 154(b) by 272 days.

(21) Appl. No.: 17/786,723

(22) PCT Filed: Dec. 18, 2020

(86) PCT No.: PCT/FI2020/050854
§ 371 (c)(1),
(2) Date: Jun. 17, 2022

(87) PCT Pub. No.: WO2021/123504
PCT Pub. Date: Jun. 24, 2021

(65) Prior Publication Data

US 2023/0031382 A1 Feb. 2, 2023

(30) Foreign Application Priority Data

Dec. 19, 2019 (FI) ..... 20196109

(51) Int. Cl.
*D21H 21/36* (2006.01)
*D21C 5/00* (2006.01)
(Continued)

(52) U.S. Cl.
CPC ..... *D21H 21/36* (2013.01); *D21C 5/005* (2013.01); *D21C 9/163* (2013.01); *D21D 5/28* (2013.01)

(58) Field of Classification Search
CPC ..... D21H 21/36; D21D 5/28; D21C 9/163
See application file for complete search history.

(56) References Cited

U.S. PATENT DOCUMENTS

2019/0024306 A1* 1/2019 Hietaniemi ..... D21H 17/375
2019/0145052 A1 5/2019 Kolari et al.

FOREIGN PATENT DOCUMENTS

CN 102292499 A 12/2011
CN 103667201 A 3/2014
(Continued)

OTHER PUBLICATIONS

Murali et al., The Effect of Different Heavy Metal Acetate Solutions on Inhibition of Catalase Enzyme, 2017, Journal of the South Carolina Acdemy of Science, 15(2), p. 68-74 (Year: 2017).*
(Continued)

*Primary Examiner* — Anthony Calandra
(74) *Attorney, Agent, or Firm* — Meunier Carlin & Curfman LLC

(57) ABSTRACT

The present invention relates to a process for manufacturing a fibre web, such as paper, board, tissue or the like. In the process bleached cellulose-containing fibres are suspended into process water in order to prepare a fibre stock, which comprises residual hydrogen peroxide. The process comprises at least one pulp storage tower through which the fibre stock is transferred before it is formed into a fibrous web and dried. Zinc ions are introduced to the fibre stock or one of its constituents to maintain the amount of residual hydrogen peroxide in the fibre stock at or above a predetermined threshold level after at least one pulp storage tower.

19 Claims, 3 Drawing Sheets

(51) Int. Cl.
*D21C 9/16* (2006.01)
*D21D 5/28* (2006.01)

(56) References Cited

FOREIGN PATENT DOCUMENTS

| | | | | | |
|---|---|---|---|---|---|
| EP | 1467017 | A1 | | 10/2004 | |
| EP | 2390408 | A1 | | 11/2011 | |
| SE | 502763 | C2 | | 1/1996 | |
| WO | 0153602 | A1 | | 6/2001 | |
| WO | 2010059762 | A | | 5/2010 | |
| WO | 2013026578 | A1 | | 2/2013 | |
| WO | WO-2013045638 | A1 | * | 4/2013 | ..... A01N 35/02 |
| WO | 2013124542 | A1 | | 8/2013 | |
| WO | 2017032927 | A1 | | 3/2017 | |
| WO | 2018193164 | A1 | | 10/2018 | |
| WO | WO-2018234635 | A1 | * | 12/2018 | ..... C12M 1/34 |
| WO | 2019190513 | A1 | | 10/2019 | |

OTHER PUBLICATIONS

Keegan et al., The Control of Catalase Based Destruction of Hydrogen Peroxide in Deinking Systems, 1995, TAPPI Recycling Symposium, p. 199-205 (Year: 1995).*

Smook, Handbook for Pulp and Paper Technologists, 1992, Angus Wilde Publications, 2nd edition, chapters 13-15 (Year: 1992).*

International Search Report and Written Opinion, in connection with International Application No. PCT/FI2020/050854, dated Mar. 18, 2021.

Search report from Finnish Patent and Registration Office, in connection with Finnish patent application No. 20196109, dated Jul. 8, 2020.

Search report and English Translation thereof issued by National Intellectual Property Administration, PRC, in corresponding Chinese application 2020800834093; dated Mar. 27, 2023, 6 pages.

* cited by examiner

PROCESS FOR MANUFACTURING A FIBRE WEB

CROSS REFERENCES

This application is a national stage application of PCT/FI2020/050854 filed on Dec. 18, 2020, claiming priority of Finnish national application number 20196109 filed on Dec. 19, 2019, the contents of both of which are incorporated herein by reference.

FIELD OF INVENTION

The present invention relates to a process for manufacturing a fibre web according to preamble of the enclosed independent claim.

BACKGROUND OF INVENTION

Hydrogen peroxide is commonly used chemical in bleaching of cellulose-containing fibres, i.e. cellulosic fibres, which are used for making of paper, board, tissue or other similar fibre webs and web-like products. The cellulosic fibres to be bleached normally originate from wood, and they may have been obtained by chemical, mechanical or thermomechanical pulping methods, or they may be obtained by pulping of recycled fibrous materials.

After the bleaching the cellulosic fibres are washed, e.g. in a wash press. All bleaching chemicals, such as hydrogen peroxide, are not consumed in the bleaching, whereby the liquid phase from the washing usually contains residual hydrogen peroxide, which can be recirculated back to the bleaching process. Irrespective of the effective washing, some residual hydrogen peroxide may remain together with the fibres and follow to the fibre stock preparation and to the wet-end of the manufacturing process of paper, board, tissue or the like. In many cases the existence of residual hydrogen peroxide in the prepared fibre stock is even considered beneficial, and the washing after bleaching is operated in a manner that leaves a certain desired level of hydrogen peroxide to the fibre suspension used for stock preparation. For example, in manufacturing processes that use bleached fibres obtained by mechanical pulping, the residual hydrogen peroxide in the fibre stock helps to maintain the brightness of the fibres and to combat the yellowing, sometimes even throughout the whole manufacturing process until the formation of web. Furthermore, when the manufacturing process is intentionally operated using residual hydrogen peroxide in the stock, the chemical dosage regimes, such as biocide dosages, are optimised for a certain residual hydrogen peroxide concentration level. It is therefore desired that the amount of residual hydrogen peroxide in the fibre stock is maintained at or above a certain pre-determined level in order to guarantee the desired brightness of the final fibre web and smooth operation of the manufacturing process.

Residual hydrogen peroxide in the fibre stock may be degraded by catalase enzyme, which may be produced by several bacteria present in the manufacturing processes of paper, board and tissue. Usually the bacterial growth is controlled by applying various biocides in amounts that are sufficient to keep the bacterial growth to the minimum. When the bacterial growth is negligible or maintained on a low level, then the existence of the catalase enzyme is low and does not cause any serious degradation of the residual hydrogen peroxide in the fibre stock. However, if there is a sudden outburst in bacterial growth, or the biocide regime for some reason fails, the catalase enzyme concentration in the fibre stock may increase to an unacceptable level and cause significant degradation of residual hydrogen peroxide present in the stock. Even if the bacterial growth in the manufacturing process may be relatively fast brought under control by applying an intensive biocide shock into the process, the negative effects caused by catalase enzyme are not affected as the biocides do not have any impact on the catalase enzyme itself, which have been produced by the bacteria. This means that the amount of the residual hydrogen peroxide in the fibre stock cannot be maintained on the desired level, which may result in lost brightness in final fibre web and/or other process disturbances. Application of a biocide shock may thus remove the bacteria from the process, but the catalase enzyme concentration in the process may remain high for a prolonged period of time, even for several days. The prolonged effect is caused e.g. by circulating water flows, which effectively spread the catalase enzyme throughout the process. The situation is worsened by closed or nearly-closed water circulations of the modern mills producing paper, board, tissue or the like, where the process waters are recirculated and reused several times and the incoming freshwater amount is minimised.

A further problem is encountered when recycled fibres are used as a raw material in a manufacturing process of paper, board, tissue or the like, and subjected for hydrogen peroxide bleaching. The use of biocides can effectively lower the amount of bacteria in the process, but catalase enzymes entering into the process together with the recycled raw materials are not affected. These catalase enzymes can quickly degrade the residual hydrogen peroxide and thus prevent providing an effective level of residual hydrogen peroxide.

Consequently, there is a need for an effective way to reduce problems caused by the catalase enzyme in the manufacturing processes of paper, board, tissue and the like in order to maintain the amount of residual hydrogen peroxide in the fibre stock at desired level which provides desired brightness to the produced fibre web.

SUMMARY OF THE INVENTION

An object of this invention is to minimise or possibly even eliminate the disadvantages existing in the prior art.

Another object of the present invention is to provide an effective and simple process for maintaining or preserving the amount of residual hydrogen peroxide in the fibre stock.

An object of the present invention is to minimise, prevent and/or reduce the degradation of the residual hydrogen peroxide in the fibre stock during the manufacture of a fibre web, such as paper, board, tissue or the like.

Another possible object of the present invention is to minimise, prevent and/or reduce the degradation of the residual hydrogen peroxide between the stock preparation and the fibre web formation.

Yet another object of the present invention is especially to minimise, prevent and/or reduce the degradation of the residual hydrogen in pulp storage tower(s).

These objects are attained with the invention having the characteristics presented below in the characterising part of the independent claim.

Some preferred embodiments of the invention are presented in the dependent claims. The features recited in the claims are mutually freely combinable unless otherwise explicitly stated.

A typical process according to the present invention for manufacturing a fibre web, such as paper, board, tissue or the like, comprises a fibre stock preparation stage, where bleached cellulose-containing fibres are suspended into process water in order to prepare a fibre stock, which comprises an amount of residual hydrogen peroxide, and at least one pulp storage tower through which the fibre stock is transferred before the fibre stock is formed into a fibre web and dried, wherein zinc ions are introduced to the fibre stock or one of its constituents to maintain the amount of residual hydrogen peroxide in the fibre stock at or above a predetermined threshold level after at least one pulp storage tower.

Now it has been surprisingly found out that the degradation of residual hydrogen peroxide in the fibre stock is effectively inhibited or decreased by introducing zinc ions to the fibre stock or to one of its constituents. This is highly unexpected as it is generally known that the divalent metal ions are usually detrimental to hydrogen peroxide and may cause peroxide degradation. The detrimental effect of divalent ions to the hydrogen peroxide is known, for example, from the bleaching processes. However, it was found that when zinc ions are present in the fibre stock it is possible to maintain the residual hydrogen peroxide at or above a desired predetermined threshold level after at least one pulp storage tower, sometimes even throughout the process until the formation of the fibre web. The theoretical background of the invention is not yet fully understood, but without wishing to be bound by any theory it is speculated that the zinc ions have an impact on the activity of the catalase enzyme produced into the process flows by the bacteria present in the manufacturing process of a fibrous web-like product, such as paper, board, tissue and the like. Typical bacteria genera in the manufacturing process may comprise one or more of *Deinococcus, Bacillus, Paenibacillus, Pseudomonas, Pseudoxanthomonas, Tepidimonas* and related bacterial genera

DETAILED DESCRIPTION OF THE INVENTION

Figure 1A:
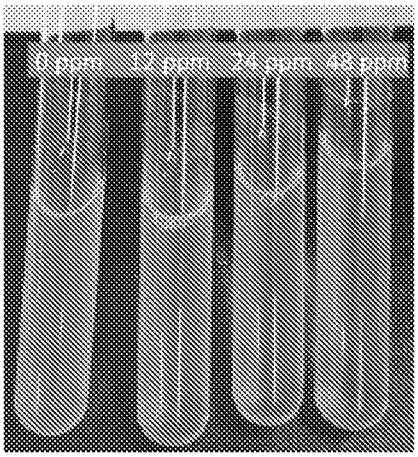
FIG. 1*a*. shows samples of *Deinococcus* spp. bacteria, originally isolated from a paper machine, was divided into four samples and grown in test tubes for one day in R2 nutrient broth liquid under agitation (37° C., 100 rpm) to produce catalase enzymes in the liquid.

The process comprises a fibre stock preparation stage. Fibre stock is prepared by suspending at least bleached cellulose-containing fibres into process water. The cellulose-containing fibres have been bleached to a desired brightness before the fibre stock preparation stage in a bleaching process that employs hydrogen peroxide as a bleaching chemical. This means that the prepared fibre stock, which comprises bleached fibres, will also comprise an amount of residual hydrogen peroxide which comes to the stock preparation stage together with the bleached fibres. A part of the residual hydrogen peroxide may enter the stock also together with the process water. The amount of the residual hydrogen peroxide in the fibre stock, at the time of stock preparation, preferably before the introduction of the zinc ions, may be at least 50 mg/l, preferably at least 75 mg/l, more preferably at least 100 mg/l. The amount of residual hydrogen peroxide may be, for example, in a range of 50-300 mg/l, preferably 75-275 mg/l, more preferably 100-250 mg/l or 150-200 mg/l.

In the present context the term "cellulose-containing fibres" denotes all fibres which comprise cellulose. The cellulose-containing fibres may further comprise hemicellulose and/or lignin and/or other constituents typical for fibres obtained from wood, non-wood biomass, agricultural waste, etc. However, the main individual constituent of the bleached cellulose-containing fibres is cellulose. In the present application the expression "cellulosic fibres" is used synonymously with the expression "cellulose-containing fibres", and the expressions are identical and fully interchangeable.

The fibre stock of the present invention comprises, in addition to process water, bleached cellulose-containing fibres as defined above. The cellulose-containing fibres may have been obtained by any suitable pulping method, such as chemical pulping, mechanical pulping, thermomechanical pulping or chemi-thermomechanical pulping, preferably by mechanical, thermomechanical or chemi-thermomechanical pulping. According to a preferable embodiment the cellulosic fibres are obtained by mechanical pulping or thermomechanical pulping. The fibre stock may further contain, for example, various treatment chemicals, mineral fillers, biocides, etc. as is customary in the art.

According to one embodiment of the invention the bleached cellulose-containing fibres are or comprise recycled fibres.

According to one embodiment of the invention the bleached cellulose-containing fibres comprise a mixture of virgin fibres obtained by one of the pulping methods listed above, preferably by mechanical pulping or thermomechanical pulping, and of recycled fibres.

The temperature of the fibre stock in the manufacturing process is usually 20-60° C., preferably 30-55° C., more preferably 40-50° C.

The process comprises at least one pulp storage tower or tank through which the fibre stock is transferred before the fibre stock is formed into a fibre web and dried. In the present text the terms pulp storage tower, pulp storage tank and pulp mixing tanks are used synonymously. All references and embodiments relating to pulp storage towers are fully applicable to pulp storage tanks. The process may comprise one pulp storage tower or a plurality of pulp storage towers, arranged in parallel or in series. The pulp storage tower comprises an inlet, through which the fibre stock enters the storage tower and an outlet, through which the fibre stock exits the storage tower. Residence time is here understood as the average amount of time the fibre stock resides in the pulp storage tower, i.e. the time difference between the entry through the inlet and exit through the outlet.

Zinc ions are introduced to the fibre stock or one of the constituents of the fibre stock, e.g. process water, to maintain the amount of residual hydrogen peroxide in the fibre stock at or above a predetermined threshold level after at least one pulp storage tower. According to one embodiment of the invention zinc ions are introduced to the fibre stock or one of the constituents of the fibre stock, e.g. process water, to maintain the amount of residual hydrogen peroxide in the fibre stock at or above a predetermined threshold level even at the formation of the fibre web. The amount of residual hydrogen peroxide usually gradually decreases from the fibre stock preparation stage to the fibre web formation, as some degradation occurs due to the chemical reactions with fibres. The risk for degradation of the residual hydrogen peroxide is especially great in pulp storage towers, where the residence time of the fibre stock is often >0.25 h, >0.5 h, >1 h, or even >2 h, and the conditions for bacterial growth and for the associated catalase enzyme formation are favourable. Without the addition of zinc ions an accelerated hydrogen peroxide degradation may occur in presence of the formed catalase enzymes, as one catalase enzyme molecule can degrade millions of peroxide molecules within a minute. The addition or introduction of the zinc ions prevents or slows down the degradation and maintains the amount of the residual hydrogen peroxide at or above the predetermined threshold level even after the pulp storage tower(s). The threshold level is individually determined for each manufacturing process, and it is dependent on the hydrogen peroxide amount in the fibre stock, as well as the desired residual peroxide level for which the overall process and its individual subprocesses have been optimized.

The initial hydrogen peroxide amount may be at least 50 mg/l, preferably at least 75 mg/l, more preferably at least 100 mg/l. The initial hydrogen peroxide amount may be, for example, in a range of 50-300 mg/l, preferably 75-275 mg/l, more preferably 100-250 mg/l or 150-200 mg/l.

The predetermined threshold level for the residual hydrogen peroxide may be at least 35% or at least 40%, preferably at least 50% or at least 70%, more preferably at least 75%, of the initial amount of the residual hydrogen peroxide. The threshold level for the residual hydrogen peroxide may be determined immediately after the outlet of the pulp storage tower(s), preferably after the outlet of the last pulp storage tower. The initial amount of the residual peroxide may be determined immediately before the pulp storage tower(s) or the first pulp storage tower in series. Alternatively, or in addition to, the threshold level may be determined for residual hydrogen peroxide in the fibre stock just before the fibre web formation, e.g. at the headbox or immediately before the headbox. For example, the threshold level for the residual hydrogen peroxide after the pulp storage tower(s) and/or at the formation of the fibre web may be, for example, in a range of 20-200 mg/l, preferably 30-175 mg/l, more preferably 40-150 mg/l or 50-125 mg/l.

The zinc ions may be provided to the fibre stock by introducing an organic and/or inorganic zinc salt to the fibre stock or one of its constituents. The zinc salt may be any suitable water-soluble zinc salt capable of providing free zinc ions in water. Most preferably the zinc ions are provided by introducing at least one inorganic zinc salt to the fibre stock. The inorganic zinc salt may be selected from zinc chloride, zinc sulphate, zinc bromide, zinc iodide or any of their mixtures. Preferably the inorganic zinc salt is selected from zinc chloride, zinc sulphate or their mixture. In some embodiments zinc ions may be provided by an organic zinc salt.

The zinc ions, e.g. in form of zinc salt, may be introduced to the fibre stock or to one of its constituents in amount that provides zinc ion concentration 100 mg/l, preferably ≤75 mg/l, more preferably ≤50 mg/l, to the fibre stock. In one embodiment the zinc ion concentration in the fibre stock may be in a range of 1-100 mg/l, preferably 1-75 mg/l, more preferably 1-50 mg/l or 2-25 mg/l.

The zinc ions may be introduced to the process water, which is used in preparation of the fibre stock, for suspending the cellulose-containing fibres at the fibre stock preparation stage. Alternatively, or in addition, the zinc ions may be introduced to the fibre stock after its preparation. For example, the process according to the invention, may comprise a dilution step where the fibre stock is diluted to a desired consistency before formation of the fibre web. The zinc ions may be introduced directly to the fibre stock or they may be introduced to the process water which is used to dilute the prepared fibre stock to a desired consistency before the formation of the fibre web.

The zinc ions may be added continuously or periodically to the fibre stock and/or to one of its constituents.

The zinc ions may be introduced in any suitable location in the manufacturing process of paper, board, tissue or the like. The zinc ions may be introduced in one single introduction location or in several introduction locations situated at different points of the manufacturing process. Typically a manufacturing process for paper, board, tissue or the like comprises at least one of the following process components: a pulp mixing tank, a broke system, a pulp deinking system, a pulper, at least one water storage tank, at least one pulp storage tower and/or a pipeline before a pulp storage tower. According to one embodiment the manufacturing process comprises at least a pulper, a pulp deinking system and at least one pulp storage tower before the web formation. According to another embodiment the manufacturing process comprises at least a broke system, at least one pulp storage tower or tank and at least one water storage tank. According to the present invention zinc ions can be introduced to the process water and/or to the fibre stock in or at any of these process components.

According to one preferable embodiment the zinc ions are introduced into the fibre stock before the pulp storage tower(s). As explained above, it has been observed that the presence of the zinc ions in the fibre stock maintains or preserves the amount of residual peroxide at the desired level even if unwanted microbial growth is present in the pulp storage tower(s).

Preferably the amount of residual hydrogen peroxide is determined at least in one process location, for example at an outlet of a pulp storage tower or tank, between the introduction of the zinc ions and the formation of the fibre web. The determined amount of residual hydrogen peroxide can be used to control the introduction of the zinc ions. For example, if the amount of residual hydrogen peroxide falls under the predetermined threshold level, the amount of zinc ions introduced to the fibre stock or to one of its constituents may be increased until the residual hydrogen peroxide is restored to the desired level.

According to one preferable embodiment the amount of the residual hydrogen peroxide at the fibre stock preparation stage and after at least one pulp storage tower or tank is determined, wherein the difference between the determined amounts is less than 65% or less than 60%, preferably less than 50% or less than 30%, more preferably less than 25%. In other words, the amount of residual hydrogen peroxide is maintained throughout pulp storage tower, when determined at the outlet of the pulp storage tower, on a level which is at least 35% or at least 40%, preferably at least 50% or at least 70%, more preferably at least 75%, of the amount determined at the inlet of the pulp storage tower. The amount of residual hydrogen peroxide may be maintained throughout the process, even if the fibre stock has been stored or resided in a pulp storage tower or tank having a residence time of >0.25 h, >0.5 h, >1 h or >2 h, from the preparation of the fibre stock to the formation of the fibre web on a level which is at least 35% or at least 40%, preferably at least 50% or at least 70%, more preferably at least 75%, of the original residual hydrogen peroxide value, determined at the fibre stock preparation or immediately after the fibre stock preparation.

The amount of the residual hydrogen peroxide in the fibre stock, at the stock preparation stage, after the pulp storage tower(s) and/or at the fibre web formation, may be determined either continuously or at pre-determined time intervals in order to determine, monitor and/or control the level of the residual hydrogen peroxide in the manufacturing process of paper, board, tissue or the like. Any suitable method or device may be used for the determination of the amount of the hydrogen peroxide.

According to one preferable embodiment the amount of residual hydrogen peroxide may be determined by titrimetric or colorimetric measurement. For example, hydrogen peroxide may be measured by using commercial test strips, which change colour according to the hydrogen peroxide concentration. Alternatively, hydrogen peroxide can be determined by redox titration with permanganate or by potentiometric titration.

According to another embodiment the amount of residual hydrogen peroxide may be indirectly determined by measuring an oxidation-reduction potential value of the fibre stock. Oxidation-reduction potential (ORP) value may be determined by using an ORP probe, such as a redox electrode. This kind of devices are known as such for a person skilled in the art, and not explained in more detail in this application.

It is also possible to determine a brightness value of the fibre stock or of the produced fibre web. The determined brightness value may be used to control the introduction of the zinc ions. For example, if the determined brightness level of the formed fibre web falls under a desired target brightness, then the amount of zinc ions introduced to the fibre stock or to one of its constituents may be increased until the brightness of the fibre web is restored to the desired target brightness. The desired target brightness may vary according to the brightness or whiteness of a fibre stock after bleaching. Typically, brightness of a bleached chemi-thermo mechanical pulp (CTMP) is from 65 to 76% ISO. Typically, brightness of a bleached mechanical pulp is from 70 to 75% ISO. Brightness of pulp containing recycled fibres may vary within a broad range, even after bleaching, depending e.g. whether the pulp contains ink. The desired target brightness may be 50-80% ISO, preferably 55-75% ISO, preferably 60 to 75% ISO, and it typically depends on a fibre mixture used. All % ISO values given above are % ISO, measured by using standard ISO 2470.

It is generally desired that the brightness value of the formed fibre web compared to the brightness value of a mixture of cellulose-containing fibres after possible bleaching is within desired limits. Typically, it would be beneficial, that the brightness value of the formed fibre web, compared to the value at the fibre stock preparation, has not decreased more than 10% ISO units, not more than 8% ISO units, not more than 6% ISO units, not more than 5% ISO units, not more than 4% ISO units, not more than 3% ISO units, not more than 2% ISO units, or not more than 1% ISO units, or is even less than 1% ISO unit change. All % ISO values given above are % ISO, measured by using standard ISO 2470.

According to one preferred embodiment of the invention the zinc ions may be introduced to the fibre stock or the stock constituents independently from any possible biocide feeding regime.

In a typical process for manufacturing a fibre web, such as paper, board, tissue or the like,

- bleached cellulose-containing fibres are suspended into process water in order to prepare a fibre stock, wherein the fibre stock comprises residual hydrogen peroxide,
- the fibre stock is formed into a fibre web and dried, and
- zinc ions are introduced to the fibre stock or one of its constituents to maintain the amount of residual hydrogen peroxide in the fibre stock at or above a predetermined threshold level at the formation of the fibre web.

Even if the present method is especially suitable for a manufacturing process of a fibre webs, such as paper, board, tissue or the like, the method is equally applicable to any manufacturing process using bleached cellulosic fibres and where there is a need to maintain the amount of the residual hydrogen peroxide at or above predetermined threshold level.

EXPERIMENTAL

Some embodiments of the present invention are described in the following non-limiting examples.

Example 1 a

Figure 1B:
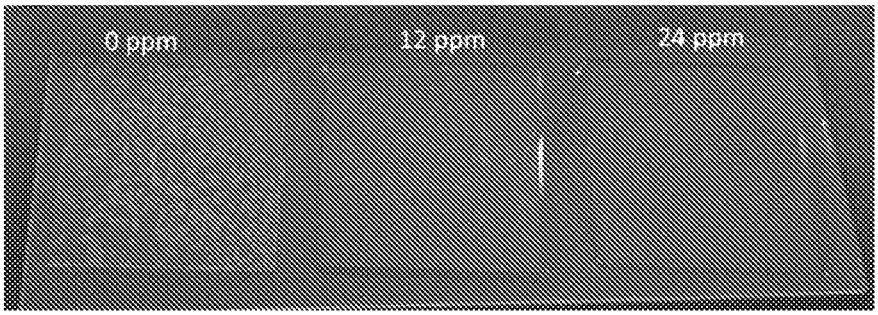
FIG. 1*b* illustrates activity of catalase enzyme observed by recording the amount of gas bubbles formed in 5 minutes after adding hydrogen peroxide. Plenty of bubbles from degradation of hydrogen peroxide were observed at 0 ppm of zinc, a couple of bubbles were observed at 12 ppm, and none at 24 ppm.

*Deinococcus* spp. bacteria, originally isolated from a paper machine, was divided into four samples and grown in test tubes for one day in R2 nutrient broth liquid under agitation (37° C., 100 rpm) to produce catalase enzymes in the liquid as shown in FIG. 1*a*. Different samples were prepared without zinc or with addition of different concentrations of zinc ions. According to visual observation of turbidity of the liquid, the amount of cells was similar in all four test tubes. Hydrogen peroxide was added to the test tubes for final concentration of 0.5%. Activity of catalase enzyme was observed by recording the amount of gas bubbles formed in 5 minutes after adding hydrogen peroxide. The results are shown in FIG. 1*b*. Plenty of bubbles from degradation of hydrogen peroxide were observed at 0 ppm of zinc, a couple of bubbles were observed at 12 ppm, and none at 24 ppm (FIG. 1*b*).

Results of Example 1 thus demonstrate a clear reduction of hydrogen peroxide degradation in the presence of zinc ions.

Example 1 b

Figure 1C:
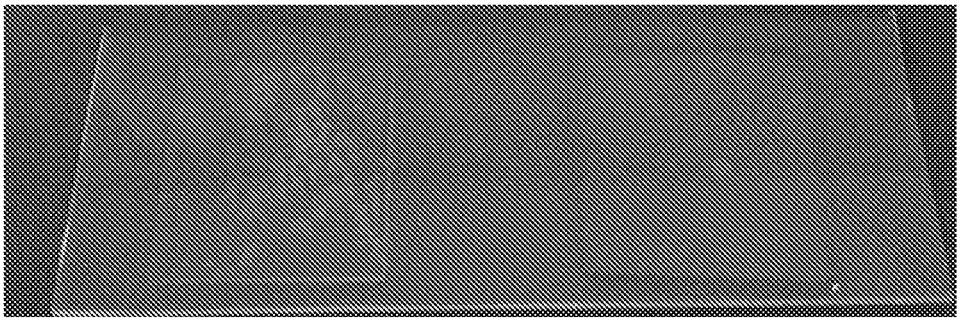
FIG. 1*c* illustrates the impact of zinc concentration, 0 mg/l(left) or 12 mg/l (right), on the amount of gas bubbles formed by peroxide degradation were observed by cultivating *Bacillus* spp. bacteria, originating form a paper machine, for catalase production, Photographs were taken 5 minutes after adding hydrogen peroxide in the liquid.

The procedure of Example 1 a was repeated, but by cultivating *Bacillus* spp. bacteria, originating from a paper machine, for catalase production. The results are shown in FIG. 1*c*, which shows the impact of zinc concentration, 0 mg/l(left) or 12 mg/l (right), on the amount of gas bubbles formed by peroxide degradation were observed. Photos were taken 5 minutes after adding hydrogen peroxide in the liquid. Results of Example 1 b demonstrate clearly reduced degradation of hydrogen peroxide by catalase in the presence of zinc ions.

Example 2

Figure 2:
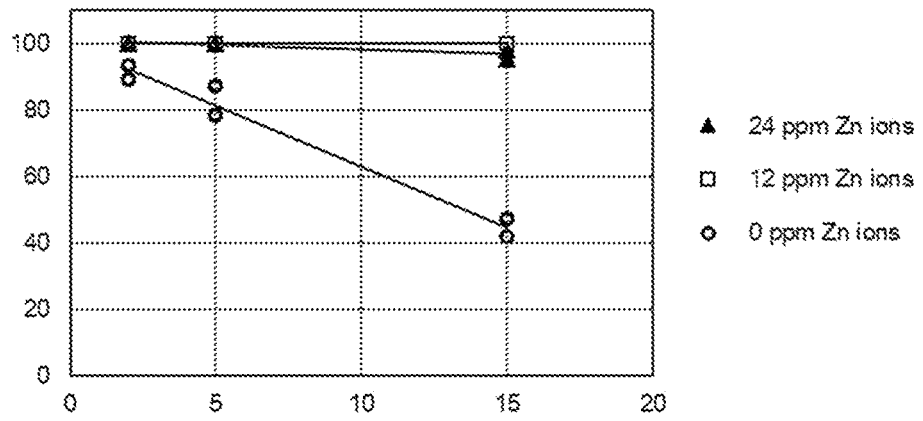
FIG. 2 shows results from example 2 described below with *Deinococcus* spp. Bacteria.

*Deinococcus* spp. bacteria, originally isolated from a paper machine, was grown in test tubes for 3 days in R2 nutrient broth liquid under agitation (45° C., 100 rpm) to produce catalase enzymes in the liquid. Different samples were prepared without zinc or with addition of different concentrations of zinc ions. Hydrogen peroxide was added to the samples for final concentration of 100 mg/l as hydrogen peroxide. Decrease in hydrogen peroxide concentration in time was monitored quantitatively by Reflectoquant Peroxide Test Strips (20-100 mg/l, MilliporeSigma). The results are shown in FIG. 2. It is seen that hydrogen peroxide was degraded only in the absence of zinc ions, and the presence of 12 ppm and 24 ppm of zinc ions protected peroxide from degradation. In FIG. 2, the X-axis shows the contact time of the liquid with hydrogen peroxide (min), and the Y-axis shows the remaining hydrogen peroxide in ppm.

Example 3a

Figure 3:
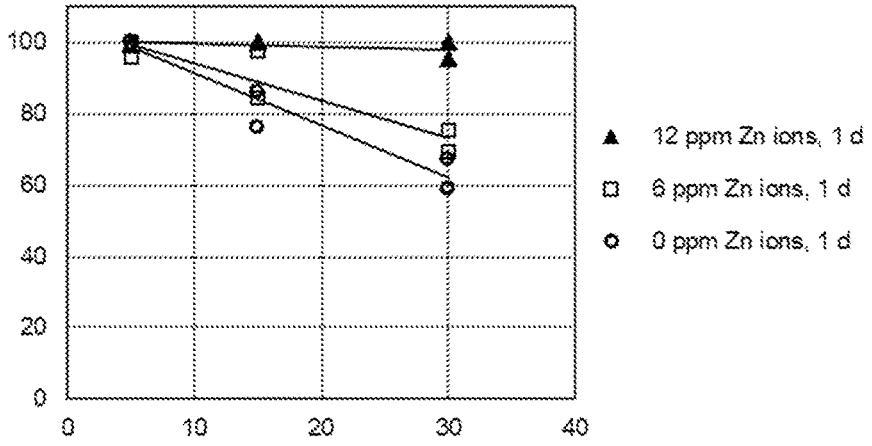
FIG. 3 shows the impact of zinc ion concentration on the speed of hydrogen peroxide degradation by catalase enzyme originating from bacteria from paper machine (example 3a below).

A process water sample from a paper machine #1 using peroxide bleached pulp was mixed with simulated paper machine process water (SPW) in ratio 1:99. A high catalase activity was allowed to develop for 18 h. Fresh SPW and different concentrations of zinc ions were added. Next day, hydrogen peroxide was added to the samples in final concentration of 100 mg/l. Decrease in hydrogen peroxide concentration in time was monitored quantitatively by Reflectoquant Peroxide Test Strips (20-100 mg/l, MilliporeSigma). Results are shown in FIG. 3. FIG. 3 shows the impact of zinc ion concentration on the speed of hydrogen peroxide degradation by catalase enzyme originating from bacteria from paper machine #1, bacteria concentration $>10^6$ cfu/ml in all water samples. It is seen that the presence of zinc ions at a sufficient concentration reduced hydrogen peroxide degradation. In FIG. 3, the X-axis shows the contact time of the liquid with hydrogen peroxide (min), and the Y-axis shows the remaining hydrogen peroxide in ppm.

Figure 4:
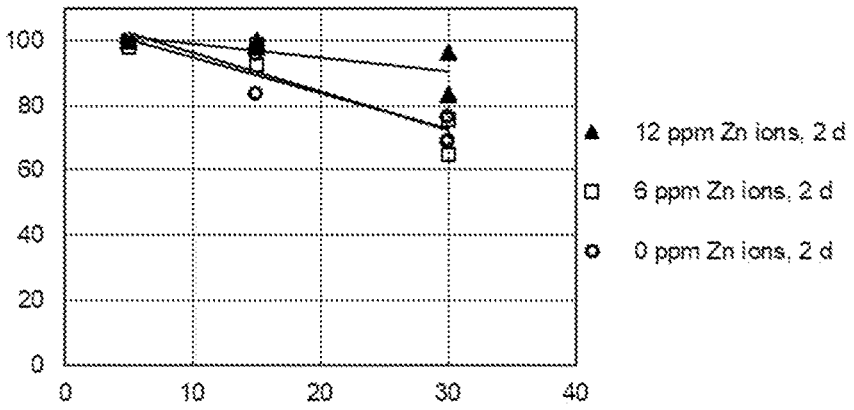
FIG. 4 shows the extended impact of zinc ion concentration on the speed of hydrogen peroxide degradation by catalase enzyme originating from bacteria from paper machine (example 3a below).

The longevity of zinc ion effect was followed up by repeating the test one day later with the same water samples and fresh hydrogen peroxide addition. Results are shown in FIG. 4. FIG. 4 shows the extended impact of zinc ion concentration on the speed of hydrogen peroxide degradation by catalase enzyme originating from bacteria from paper machine #1, bacteria concentration ca. $10^8$ cfu/ml in all water samples. It is seen that the presence of zinc ions at a sufficient concentration reduced peroxide degradation for extended time period of time. In FIG. 4, the X-axis shows the contact time of the liquid with hydrogen peroxide (min), and the Y-axis shows the remaining hydrogen peroxide in ppm.

Example 3b

Figure 5:
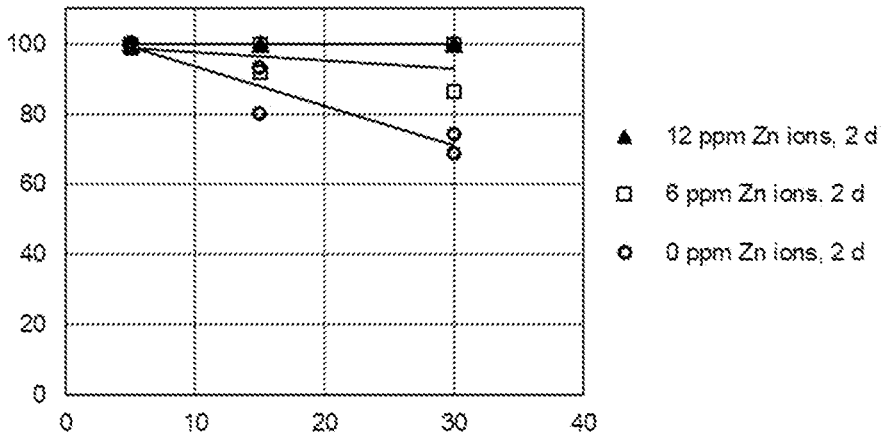
FIG. 5 shows the impact of zinc ion concentration on the speed of hydrogen peroxide degradation by catalase enzyme originating from bacteria from paper machine (example 3b below).

The procedure of Example 3a was repeated, but by using another process sample from paper machine #2. Results are shown in FIG. 5. FIG. 5 shows the impact of zinc ion concentration on the speed of hydrogen peroxide degradation by catalase enzyme originating from bacteria from paper machine #2, bacteria concentration $>10^7$ cfu/ml in all water samples. Results from the two-day-experiment show that presence of zinc ions did reduce hydrogen peroxide degradation. In FIG. 5, the X-axis shows the contact time of the liquid with hydrogen peroxide (min), and the Y-axis shows the remaining hydrogen peroxide in ppm.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A process for manufacturing a fibre web, which process comprises:

a fibre stock preparation stage, where bleached cellulose-containing fibres are suspended into process water in order to prepare a fibre stock, which comprises an amount of the residual hydrogen peroxide, and at least one pulp storage tower through which the fibre stock is transferred before the fibre stock is formed into a fibre web and dried, wherein zinc ions are introduced to the fibre stock or one of its constituents to maintain the amount of residual hydrogen peroxide in the fibre stock at or above a predetermined threshold level after at least one pulp storage tower, and the amount of residual hydrogen peroxide is determined at least in one process location between the introduction of the zinc ions and the formation of the fibre web, and the determined amount is used to control the introduction of the zinc ions.

2. The process according to claim 1, wherein zinc ions are introduced to the fibre stock or one of its constituents to maintain the amount of residual hydrogen peroxide in the fibre stock at or above a predetermined threshold level at formation of the fibre web.

3. The process according to claim 1, wherein the amount of residual hydrogen peroxide in the fibre stock is maintained at or above a predetermined threshold level, which is at least 35% of an initial amount of the residual hydrogen peroxide.

4. The process according to claim 1, wherein the amount of residual hydrogen peroxide in the fibre stock is maintained at or above a predetermined threshold level of 20-200 mg/l.

5. The process according to claim 1, wherein the zinc ions are introduced to the process water, which is used to suspend the cellulose-containing fibres at the fibre stock preparation stage.

6. The process according to claim 1, wherein the method comprises a dilution step where the fibre stock is diluted to a desired consistency before formation of the fibre web and the zinc ions are introduced to the process water, which is used to dilute the fibre stock.

7. The process according to claim 1, wherein the zinc ion concentration in the fibre stock is ≤100 mg/l.

8. The process according to claim 1, wherein the process further comprises at least one of the following: a broke system; pulp deinking system; pulper; a water storage tank; and/or a pipeline before the pulp storage tower, and that the zinc ions are introduced to the process water and/or to the fibre stock in or at any of these.

9. The process according to claim 1, wherein an inorganic zinc salt is introduced to the fibre stock or one of its constituents for providing the zinc ions.

10. The process according to claim 9, wherein the inorganic zinc salt is selected from zinc chloride, zinc sulphate or their mixtures.

11. The process according to claim 1, wherein the amount of the residual peroxide is determined at the fibre stock preparation and after at least one storage pulp storage tower, wherein the difference between the determined amounts is less than 65%.

12. The process according to claim 11, wherein the amount of residual hydrogen peroxide is determined by titrimetric or colorimetric measurement, or indirectly determined by measuring an oxidation-reduction potential value of the fibre stock.

13. The process according to claim 1, wherein the amount of residual hydrogen peroxide is determined by titrimetric or colorimetric measurement, or determined indirectly by measuring oxidation-reduction potential value of the fibre stock.

14. The process according to claim 1, wherein a brightness value of the fibre stock or of the produced fibre web is determined, and the determined brightness value is used to control the introduction of the zinc ions.

15. The process according to claim 1, wherein the cellulose-containing fibres are obtained by mechanical pulping or thermomechanical pulping.

16. The process according to claim 1, wherein the cellulose-containing fibres are recycled fibres.

17. The process according to claim 1, wherein an initial amount of the residual hydrogen peroxide in the fibre stock is at least 50 mg/l.

18. The process according to claim 1, wherein the amount of the residual peroxide is determined at the fibre stock preparation and after at least one storage pulp storage tower, wherein the difference between the determined amounts is less than 60%.

19. The process according to claim 1, wherein the fibre web comprises a paper, board, or tissue.

* * * * *